United States Patent [19]

Stickel et al.

[11] Patent Number: 4,918,954

[45] Date of Patent: Apr. 24, 1990

[54] LOCK MECHANISM FOR EQUIPMENT OF DATA PROCESSING TECHNOLOGY

[75] Inventors: Heinz Stickel, Groebenzell; Peter Reihl, Munich, both of Fed. Rep. of Germany

[73] Assignee: Siemens Aktiengesellschaft, Berlin and Munich, Fed. Rep. of Germany

[21] Appl. No.: 365,740

[22] Filed: Jun. 14, 1989

[30] Foreign Application Priority Data

Jun. 14, 1988 [DE] Fed. Rep. of Germany ..... 8807729

[51] Int. Cl.[5] ..... E05B 65/06

[52] U.S. Cl. ..... 70/134; 70/57; 292/83

[58] Field of Search ..... 70/57, 58, 129, 134, 70/135, 139, 265, 264, 252; 292/83, 85

[56] References Cited

U.S. PATENT DOCUMENTS

| | | | |
|---|---|---|---|
| 530,078 | 12/1894 | Ammerman | 292/85 |
| 2,896,989 | 7/1959 | Hitzelberger | 292/83 |
| 4,060,123 | 11/1977 | Hoffman | 70/57 |

*Primary Examiner*—Robert L. Wolfe

*Attorney, Agent, or Firm*—Hill, Van Santen, Steadman & Simpson

[57] ABSTRACT

A locking mechanism for data processing equipment includes a spring with a catch nose which is biased towards a locking position where it engages behind a shoulder and is lifted into an unlocking position against spring power either by a pivoted lever of a key-operated lock or, independently therefrom, by movement of one of the parts to be locked. An electrical locking and unlocking also occurs as the lever is moved into an unlocking position where it engages and operates a microswitch.

20 Claims, 1 Drawing Sheet

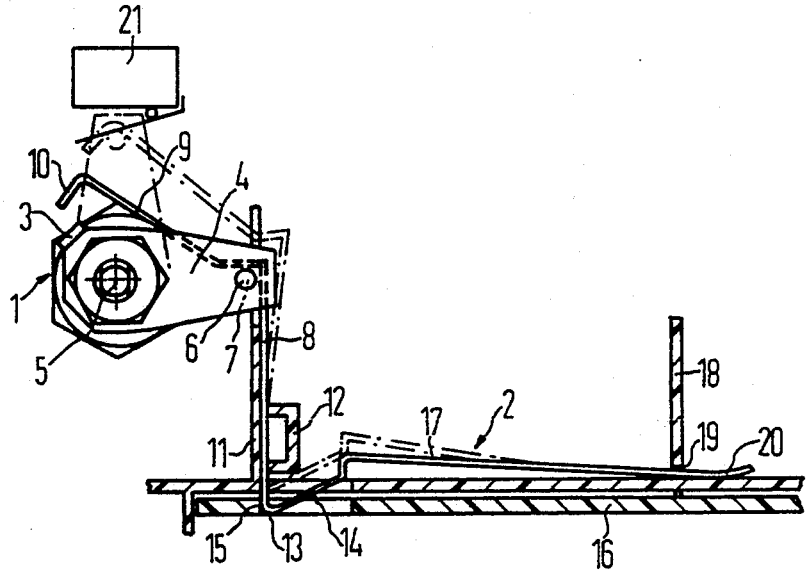
21
10
9
4
3
1
5
6
7
8
12
11
17
2
18
19
20
15
13
14
16

LOCK MECHANISM FOR EQUIPMENT OF DATA PROCESSING TECHNOLOGY

BACKGROUND OF THE INVENTION

1. Field of the Invention

The present invention relates to a lock mechanism for equipment of data processing technology comprising a microswitch and a key-operable pivoted lever lock whose pivoted lever is displaceable into a locking position and into an unlocking position against the force of an over deadcenter spring secured to the pivot lever and comprises both a locking element for a locking device of a first part to be locked and an actuation element assigned to the microswitch, which actuation element presses against a contact element of the microswitch in the locking position of the pivoted lever.

2. Description of the Prior Art

Equipment such as, for example, personal computers that should only be accessible to authorized persons are frequently utilized in data processing technology. To this end, for example, these equipment are equipped with a key-operable lock or, respectively, are made lockable. The lock either interrupts the power supply, suppresses access to the control panel, for example the keyboard, with a mechanical cover lying thereabove, or carries out both operations simultaneously.

Locks that effect both a quasi-electrical and a mechanical locking or known per se. Such locks are employed in automotive engineering as what are referred to as ignition locks, whereby the microswitch controls the central locking of the doors of a vehicle. Such locks, however, are expensive and waste space for equipment of data processing technology and, in particular, for personal computers. Most cost-effective lock mechanisms have therefore become known in data processing technology that likewise enable an electrical and a mechanical locking. These lock mechanisms employ a simple pivoted lever lock as employed, for example, as a cassette lock, as well as in combination with a microswitch. The microswitch is thereby directly or indirectly actuated by the pivoted lever, whereby the pivoted lever also serves as a mechanical lock element for, for example, a cover over a keyboard, or for the housing of a computer. Since intermediate positions are possible given these simple pivoted lever locks, regardless of whether they comprise a latching at the detent that marks the final positions are not, and overdead center spring that pulls the pivoted lever into the respective end position is additionally installed at the pivoted lever.

What is disadvantageous in the case of such lock mechanisms is that they comprise only one mechanical interlock device. In personal computers, for example, this one interlock device is frequently not adequate in order to sufficiently protect the device against access by unauthorized persons because, for example, mechanical access to the mass memory device such as diskettes and/or cassette tape drives are always still possible. The user must therefore exercise care that he removes the diskettes or magnetic tape cassettes inserted into these memory drives as soon as he leaves the equipment, in order to prevent a possible misuse. A lock mechanism that comprises yet a second mechanical interlock device, in addition to the two interlock types that were heretofore simultaneously executed, namely electrical, on the one hand, and mechanical, on the other hand, is therefore advantageous, the mentioned equipment components being mechanically locked with a second cover on the basis of this second mechanical interlock device. Diskettes or, respectively, tape cassettes can then be left in the drive units. At the same time, the drive units are also protected against disassembly.

One solution of this problem, for example, is in providing a pivoted lever lock of the type initially mentioned with a second pivoted lever, that directly arrests a second lockable part via an additional lock bolt. The lock bolt can be loaded in the locking position by a spring, so that the second pivoted lever only has to pull the lock bolt into the unlocked position as needed. This lock mechanism therefore requires a great number of individual component parts.

SUMMARY OF THE INVENTION

It is therefore an object of the invention to provide a second mechanical interlock device in a lock mechanism of the type set forth above that, following the actual locking event, also enables a subsequent locking of the second part to be locked and that comprises only a few component parts.

The above object is achieved, according to the present invention, in a lock mechanism of the type set forth above and which is particularly characterized in that the pivoted lever comprises an additional actuation element that is coupled via a plane bearing to an additional locking element which is blocking element displaceable into a locking position and into an unlocking position that the blocking element respectively assumes in either the locking position or the unlocking position together with the pivoted lever, and in that a subregion of the blocking element is fashioned such and is allocated such to a locking device of a second part to be locked that this subregion also engages into the locking device of the second part to be locked when the blocking element is in the locking position and therefore arrests the second part to be locked.

According to a particular feature of the invention, the blocking element is constructed as a leaf spring over whose course a catch nose is provided that, in the locking position, engages behind a supporting shoulder of the second part to be locked.

According to another feature of the invention, the additional actuation element is fashioned as a lateral bolt that projects from the pivoted lever and extends parallel to the pivoting axis of the pivoted lever.

According to another feature of the invention, the second part to be locked is constructed as a longitudinally displaceable slide and the supporting shoulder is formed by a wall section of a recess in the slide.

According to another feature, the invention is particularly characterized in that an inclined wall section that serves as a starting incline for the slide is provided following upon the catch nose of the leaf spring.

According to another feature, the leaf spring is resiliently stressed opposite the lifting direction of the catch nose.

According to another feature of the invention, the leaf spring is composed of a plurality of subsections describing an angle with one another, that the first end part projecting from a middle section at an angle embraces a laterally-projecting bolt of the pivoted lever in the angular range and comprises a detent at its free end that limits the pivoting range of the pivoted lever, in that the other end region of the middle section is fashioned as a catch nose having a starting incline adjoining thereto, and that the second end part adjoining thereto is fashioned as a spring arm whose free end is clamped stressed by torque.

According to another feature, the invention is particularly characterized in that the free end of the spring arm is plugged into a recess of a supporting wall and is supported, first of all, via the edge of the recess and, secondly, via a bend location at the free end of the spring end.

According to another feature, the invention is particularly characterized in that the middle section of the leaf spring is seated sliding in the longitudinal direction.

According to another feature, the invention is particularly characterized in that, the spring arm of the leaf spring is arcuately constructed.

Advantageously, and as set forth above, the block element is preferably fashioned as a leaf spring that is simple to manufacture. The leaf spring is arranged next to the pivoted lever lock, so that the mounting depth of the lock mechanism is slight in comparison to a lock mechanism comprising a helical over deadcenter spring arranged behind the lever lock.

BRIEF DESCRIPTION OF THE DRAWING

Other objects, features and advantages of the invention, its organization, construction and operation will be best understood from the following detailed description, taken in conjunction with the accompanying drawing, on which there is a single FIGURE which is a view of an embodiment of the invention shown substantially in section.

DESCRIPTION OF THE PREFERRED EMBODIMENTS

Referring to the drawing, a lock mechanism is shown in a rear view of an interlock position. The lock mechanism, mounted on a rack 22, essentially includes a pivoted lever lock 1, a leaf spring 2 that, among other things, exercises the function of a lock bolt, and a microswitch 21. The pivoted lever lock 1 can be operated in a known manner with a key. For a first part (not shown in detail on the drawing) to be locked, it comprises an interlock hook 3 that emerges perpendicularly out of the plane of the leaf spring and that engages, for example, into a retaining hook of the first part to be locked when it is in its interlock position. The retaining hook is thereby arranged such that the interlock hook pivots out of the retaining hook when it is displaced into the unlocking position.

The pivoted lever lock 1 also comprises a pivoted lever 4 that can be pivoted around a pivoting access 5. For example, the pivoted lever 4 is a sheet metal part at which the interlock hook 3, formed of an angled tab, is additionally arranged. The first actuation element that is fashioned as a bolt 6 in the exemplary embodiment is arranged at that end of the pivot lever 4 that projects radially from the pivoting axis 5. Basically, the bolt 6 can project at both sides of the pivoted lever 4. In the exemplary embodiment, the bolt 6 is arranged at that side of the pivot lever 4 that faces toward a person viewing the drawing. It is thereby spatially assigned to a microswitch 21 such that the bolt 6 presses against a contact element of the microswitch 21 when pivoted into the interlock position.

The pivot lever 4 further comprises a second actuation element that, as a bolt 7, projects away from the pivoted lever 4 at that side facing away from a person viewing the drawing, extending parallel to the pivoting axis 5. The bolt 6 and the bolt 7 preferably extend in alignment with one another so that they yield a single bolt.

The bolt 7 actuates the leaf spring 2 such that the leaf spring is situated in the locking or, respectively, unlocking position together with the pivoted lever 4, whereby the displacement from the locking position into the unlocking position occurs opposite a spring force. Proceeding from the locking position of the lock mechanism, the bolt 7 is arranged in the angular region of a first end part 9 that projects at roughly a right angle from a middle section 8 of the leaf spring 2. The free end of the first end part 9 projecting at about a right angle thereby comprises an angled detent 10 that limits the range of pivot of the pivoted lever 4 with the bolt 7 that slides along the end part 9 when the pivoted lever 4 is displaced from the locking position into the unlocking position or, respectively, vice versa. The end part 9 is bent in the direction toward the pivoted lever lock 1 so that the pivot lever 4 experiences the effect of an over deadcenter force with the pin 7 upon displacement. The end part 9 is bent in to such an extent that the free end of the end part 9 extends roughly tangentially relative to the pivoting axis 5.

When the pivot lever 4 is pivoted from the locking position into the unlocking position, the bolt 7 first presses against the subregion of the end part 9 that projects at roughly a right angle from the middle section 8 of the leaf spring 2. The middle section 8 of the leaf spring 2 is therefore lifted somewhat. The middle section 8 is held in the lifted position when the bolt 7 slides along the inside of the end part 9 up to the detent 10.

The middle section 8 of the leaf spring 10 is guided between lateral support elements 11 and 12. During the lifting motion and in the lifted condition, the middle section 8, as indicated by the dot-dash lines, is bent slightly away from the pivot lever lock 1. As a result thereof, the middle section 8 tilts at the support element 12, this preventing the middle section 8 from sliding back into its locking position.

The other end region of the middle section 8 of the leaf spring 2 is fashioned as a catch nose 13 having a starting incline 14 joined thereto. In the locked position of the lock mechanism, the catch nose 13 engages behind a supporting shoulder 15 of an interlock device of a second part to be locked, this being formed by a wall section of a recess in this part. For example, this part can be fashioned as a slide 16 that can be displaced transversely relative to the pivot axis 5. Once having arrived into the locking position, the slide 16 can only be pushed back insofar as the same is not prevented by the catch nose 13. When the middle section 8 of the leaf spring 2 is lifted, the catch nose 13 is lifted to such an extent that the slide 16 is released. When the catch nose 13 is located in front of the slide 16 in the locking position, the catch nose 13 is briefly lifted by the incline 14 until it can engage behind the supporting shoulder 15 of the slide 16.

The free section end part of the leaf spring 2 adjoining the starting incline 14 is fashioned as a slightly bent spring arm 17. It is plugged into a recess of a supporting wall 18, being prestressed at that side facing away from the starting incline 14, whereby the spring arm 17 is supported, first of all, by way of an edge 19 of the recess 18 and secondly, via a bend location 20 at the free end of the spring arm 17. In this manner, a torque acts on the spring arm 17 for biasing the leaf spring 2 towards the locking position. When the leaf spring 2 is lifted into the unlocking position (indicated by dots-dashed lines) opposite the spring power of the spring arm 17, the spring force increases and the leaf spring 2 makes an even greater attempt to assume its locking position. Stable end positions of the lever 4, however, are achieved by the bend location and by the detent 10 of the end part 9.

Many changes and modifications of the invention may be made by one skilled in the art without departing from the spirit and scope of the invention. We therefore intend to include within the patent warranted hereon all such changes and modifications as may reasonably and properly be included within the scope of our contribution to the art.

We claim:

1. A lock mechanism for data processing equipment, comprising:

a rack including movable locking means biased towards a locking position;

a switch mounted on said rack to be actuated into a locked condition or an unlocked condition, including an actuating member;

a key-operated lock mounted on said rack including a lever mounted to pivot about a pivot axis to a locking position and to an unlocking position;

a first actuation element carried by said lever for engaging said actuating member and operating said switch into the unlocked condition when said lever is pivoted to the unlocked position;

a movable part to be locked, said movable part being movable relative said rack towards and away a locking position; and a second actuation element carried by said lever to engage and move said locking means out of engagement with said movable part when said lever is pivoted to the unlocking position.

2. The lock mechanism of claim 1, wherein:

said locking means comprises a leaf spring including a catch nose for engaging said movable part.

3. The lock mechanism of claim 1, wherein:

said second actuation element comprises a bolt carried by said lever and extending parallel to the pivot axis.

4. The lock mechanism of claim 1, wherein:

said locking means comprises a leaf spring including a catch nose for engaging said movable part; and said movable part comprises a longitudinally displaceable slide including a wall section comprising a recess having a shoulder, said catch nose received in said recess and locking against said shoulder in the locking position of said lever.

5. The lock mechanism of claim 4, wherein:

said leaf spring comprises an inclined section extending from said catch nose for engaging said slide and lifting said catch nose until said catch nose is opposite said recess.

6. The lock mechanism of claim 2 and further comprising:

means prestressing said leaf spring towards said movable part.

7. The lock mechanism of claim 6, wherein:

said leaf spring comprises a plurality of sections which are disposed at angles with respect to one another, including a first section including a first end and a second end, a second section extending at an angle from said first section and engaging said second actuation element, including a detent for limiting movement of said actuation element, a bend facing in the direction toward said key-operated lock so that said pivot lever experiences the effect of an overdeadcenter force with respect to said second actuation element, a third section extending from said second end of said first section and formed as a catch nose, a fourth section, including a starting incline, extending from said third section, a fifth section extending from said fourth section, and means prestressing and connecting said fifth section to said rack.

8. The lock mechanism of claim 7, wherein:

said rack includes a wall; and said first section of said spring bears against and slides along said wall.

9. The lock mechanism of claim 7, wherein:

said fifth section of said spring is an arcuate section.

10. The lock mechanism of claim 7, wherein:

said rack comprises a first wall and a second wall perpendicular to said first wall;

said second wall comprises a recess; and said fifth section of said spring extends through said recess and includes a bend engaging said first wall.

11. A lock mechanism for data processing equipment, comprising:

a rack including a first opening therethrough;

a wall carried by said rack and including a distal end and a bearing surface extending from said first opening to said distal end;

a movable part to be locked and unlocked, said movable part including a second opening therethrough having a shoulder, said movable part being movable relative to said rack for alignment of said openings for locking;

a key-operated lock mounted on said rack including a rotatable lever which is rotatable to a locking position adjacent said wall, and an unlocking position;

first and second actuation elements carried by said lever;

a switch mounted on said rack, including a actuating member adjacent said unlocking position so that said first actuation element engages said actuating member and operates said switch; and a spring carried by said rack and mounted biased towards said movable part, said spring including a catch nose section for extending through said first and second openings to engage said shoulder for locking, a flat section for engaging and sliding along said bearing surface, and an operating section for engagement with and lifting by said section actuation element to clear said shoulder for unlocking.

12. The lock mechanism of claim 11, and further comprising:

means slidingly clamping said flat section of said spring against said bearing surface.

13. The lock mechanism of claim 11, wherein:

said movable part includes an end spaced from said shoulder; and said spring includes a ramp adjacent said catch nose for engaging said end and lifting said catch nose section as said second part is moved for locking and alignment of said first and second openings.

14. The lock mechanism of claim 11, and further comprising:

spring mounting means carried by said rack, including means defining an aperture;

said spring further comprising an elongate arcuate section having a curved distal end, said curved distal end extending through said aperture and bearing on said rack.

15. The lock mechanism of claim 11, wherein:

said operating section of said spring comprises a first portion extending at an angle to said flat section and including a bend facing in the direction towards said key-operated lock so that said first portion functions as a cam follower with respect to said second actuation element, whereat said rotatable lever experiences the effect of an overdeadcenter force with said second actuation element.

16. The lock mechanism of claim 15, wherein:

said operating section further includes a bent second portion terminating said first portion for receiving and acting as a limit for said second actuating element.

17. The lock mechanism of claim 11, wherein:

said key-operated lock comprises a radially-projecting member; and said spring includes an arm for engaging said radially-projecting member and limiting the movement of said spring after said catch nose section engages said shoulder.

18. The lock mechanism of claim 11, wherein:

said distal end of said wall comprises a slot; and said operating section of said spring extends through said slot.

19. A lock mechanism for data processing equipment, comprising:

a rack including a first planar wall having a first opening therethrough, and a second wall extending adjacent said first opening perpendicular to said first wall and including a bearing surface and a distal end having a slot therein, and a third wall spaced from said second wall and extending perpendicular to said first wall, said third wall including a third opening adjacent said first wall;

a key-operated lock mounted on said rack including a pivotal lever arm which is rotatable about an axis to a locking position and an unlocking position;

a movable part to be locked and unlocked, said movable part including a planar fourth wall movable along the play of said first wall and including a distal end and a shoulder spaced from said distal end at least partially defining a second opening to be aligned with said first opening for locking of said rack and said movable part;

spring means carried by said rack, said spring means including a slide section bearing against and slidable along said bearing surface, an elongate arm extending through said third opening to engage said first wall so that said first and second walls bias said slide section towards said fourth wall, a first follower section connected and disposed at an angle to said elongate arm and extending at an angle to said slide section and therewith forming a catch nose for locking engagement against said shoulder, said distal end of said fourth wall engaging said first follower section and lifting said catch nose to slide along said fourth wall until reaching said shoulder as said movable part is moved to align said first and second openings, a second follower section extending at an angle to said slide section and extending through said slot of said distal end of said second wall and including a bend in the direction towards said key-operated lock, and a distal end formed as a hook; and a lock actuation element carried by said lever for engaging said second follower section so that said pivotal lever arm experiences the effect of an overdeadcenter force with said lock actuating element as said lever is moved toward said unlocking position and lifting said catch nose of said spring to clear said shoulder until said lock actuation element is received in and limited in movement by said hook, and to permit said spring hook catch nose to lower under the spring bias for locking.

20. The lock mechanism of claim 19, and further comprising:

a switch mounted on said rack adjacent said locking position of said lever, said switch including an actuating member; and a further actuation element carried by said lever for engaging said actuating member of said switch as said lever is moved into said unlocking position.

* * * * *